US006022125A

United States Patent [19]

Bartasevich et al.

[11] Patent Number: 6,022,125

[45] Date of Patent: Feb. 8, 2000

[54] COMBINATION METAL HALIDE AND AUXILIARY BULB LAMP

[75] Inventors: William E. Bartasevich, Kent; John J. Andrisin, III, Akron; John J. McEllen, Chagrin Falls, all of Ohio

[73] Assignee: Advanced Lighting Technologies, Inc., Twinsburg, Ohio

[21] Appl. No.: 08/958,933

[22] Filed: Oct. 28, 1997

[51] Int. Cl.[7] ..... F21V 23/04

[52] U.S. Cl. ..... 362/251; 362/228; 362/234; 362/249; 362/263; 362/265; 362/253; 362/226; 362/88; 362/219; 362/411; 362/410; 362/414

[58] Field of Search ..... 362/228, 234, 362/249, 263, 265, 253, 226, 88, 219, 411, 410, 414

[56] References Cited

U.S. PATENT DOCUMENTS

| | | | |
|---|---|---|---|
| 2,125,440 | 8/1938 | Guth | 362/228 |
| 2,144,931 | 1/1939 | Poey | 362/228 |
| 2,441,399 | 5/1948 | De Reamer et al. | 362/228 |
| 3,930,148 | 12/1975 | Gruen | 362/228 |

*Primary Examiner*—Sandra O'Shea
*Assistant Examiner*—Ronald E. DelGizzi
*Attorney, Agent, or Firm*—Rogers & Killeen

[57] ABSTRACT

The present invention is a combination metal halide and auxiliary light bulb floor or table lamp which is suitable for home or office illumination. The lamp includes a lampholder module which provides a unitary housing for the bulb sockets and the electrical components required to operate the bulbs. The module also positions each bulb relative to the others to minimize shadowing which results when a bulb casts a shadow due to the light emanating from another bulb.

49 Claims, 9 Drawing Sheets

COMBINATION METAL HALIDE AND AUXILIARY BULB LAMP

BACKGROUND OF THE INVENTION

The present invention relates to floor and table lamps suitable for home or office illumination and, more particularly, to such lamps which include a metal halide bulb as the primary light source and which may further include one or more auxiliary light bulbs, such as incandescent or compact fluorescent bulbs, as a secondary light source. The secondary source may be illuminated separately from, or in combination with, the metal halide primary source.

The advantages of metal halide lighting include excellent lighting characteristics, long bulb life, and low cost per lumen of light output. These advantages are well known and have been exploited in various outdoor, commercial, and industrial applications such as street lighting, sports facility lighting, floodlighting, interior retail store lighting, and interior warehouse lighting.

Previously, metal halide lighting for floor and table lamps suitable for home or office illumination has been impractical due to the bulky hardware and complex electrical gear required by metal halide lighting fixtures.

Metal halide lighting fixtures require complex electrical wiring between the electrical components required to operate the bulb and the bulb socket which is critical to the proper operation of the lamp. In typical prior art metal halide floor or table lamps, the electrical components required to operate a metal halide bulb, i.e., the power supply, electronic circuitry, and associated controls, are typically located in the base of the lamp which is usually physically separated from a luminaire enclosing the metal halide socket and bulb. Because the base and luminaire are physically separated, the complex electrical wiring is usually performed during assembly of the lamp adding time and costs to the lamp assembly and requiring a much higher skilled workforce than if the wiring were performed prior to lamp assembly.

Another disadvantage of the typical prior art metal halide floor and table lamps due to the physical separation between the electronic components and the bulb sockets is the generation of radio frequency interference ("RFI") which may affect the operation of other devices such as a television or radio. These lamps often require the inclusion of additional components to suppress the RFI which adds to the cost of the lamps.

One prior approach to eliminate the need for lamp manufacturers to perform the critical electrical wiring during lamp assembly and to reduce RFI is to include the required electrical components in an electronic control capsule in the base of the metal halide bulb. This approach, however, provides an unsightly bulb which is less efficient and more expensive than a standard metal halide bulb.

Metal halide floor and table lamps for home or office illumination often include one or more auxiliary light bulbs such as incandescent or compact fluorescent bulbs for providing a secondary source of light. The auxiliary bulb or bulbs may be illuminated separately from or in combination with the metal halide bulb as desired. The auxiliary bulbs are typically arranged in a cluster which positions the auxiliary bulbs relative to the metal halide bulb and uses rigid tubing (typically referred to as S-arms) to support the auxiliary bulb sockets. Such an arrangement also requires critical electrical wiring to the auxiliary sockets during lamp assembly, thus adding time and cost to the lamp assembly.

Another important consideration in multiple bulb lamps is the relative position of each bulb to the others. It is desirous to position the bulbs to minimize shadowing which results when a bulb casts a shadow due to the light emanating from another bulb. The mounting of the bulbs in a cluster using S-arms may reduce shadowing, however, the S-arms are susceptible to bending and do not arrange the bulbs in a space efficient manner.

The luminaire which includes the cluster of bulbs also typically includes a light diffusion device such as a lamp shade to reduce glare from the illuminated bulbs. Because the cluster arrangement using S-arms is not space efficient, i.e., the bulbs are not tightly arranged, a relatively large lamp shade is required to reduce the glare, but the shade also reduces the light output from the lamp.

As previously discussed, the advantages of metal halide lighting include excellent lighting characteristics. The metal halide bulb provides natural, full-spectrum light which is glare free making metal halide floor and table lamps an excellent light source for reading or working on a computer. There is a need for providing glare free light at a computer workstation in both the home and office. Hotels, in particular, have a need for a lamp which provides a computer workstation and glare free light source in guest rooms to accommodate the business traveller. In one aspect of the present invention, the lamp base includes a power receptacle and dataport to provide a computer workstation integral with the metal halide lighting which is suitable to meet the needs of hotels.

Many people are adversely affected by seasonal lighting changes. Such effects may be alleviated by providing natural, full-spectrum light to simulate sunlight at predetermined times of the day. Thus there is a need for a floor or table lamp providing the natural full-spectrum light from a metal halide source which may be automatically controlled to illuminate at specified times of the day. In another aspect of the present invention, the illumination of the metal halide and auxiliary lamps may be automatically controlled by a timing device.

The present invention obviates many of the deficiencies of the prior art metal halide floor or table lamp suitable for home or office illumination.

Accordingly, it is an object of the present invention to provide a novel metal halide floor or table lamp suitable for use in the home or office and a novel method of manufacture of such lamps.

It is another object of the present invention to provide a novel metal halide floor or table lamp and a novel method of manufacture enabling those of but ordinary skill to assemble the lamp.

It is yet another object of the present invention to provide a novel metal halide floor or table lamp with the electronic components and bulb socket within a unitary housing.

It is still another object of the present invention to provide a novel combination metal halide and auxiliary bulb floor or table lamp which reduces RFI.

It is still another object of the present invention to provide a novel metal halide floor or table lamp using both metal halide and auxiliary bulbs which may be selectively illuminated individually or in combination.

It is a further object of the present invention to provide a novel combination metal halide and auxiliary bulb floor or table lamp which minimizes shadowing when multiple bulbs are illuminated.

It is yet a further object of the present invention to provide a novel combination metal halide and auxiliary bulb floor or table lamp including a timing device in the lamp base to provide automatic illumination of the bulbs to alleviate the adverse affects of seasonal light changes.

It is still a further object of the present invention to provide a novel metal halide floor or table lamp including a base which provides a computer workstation.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

Figure 1:
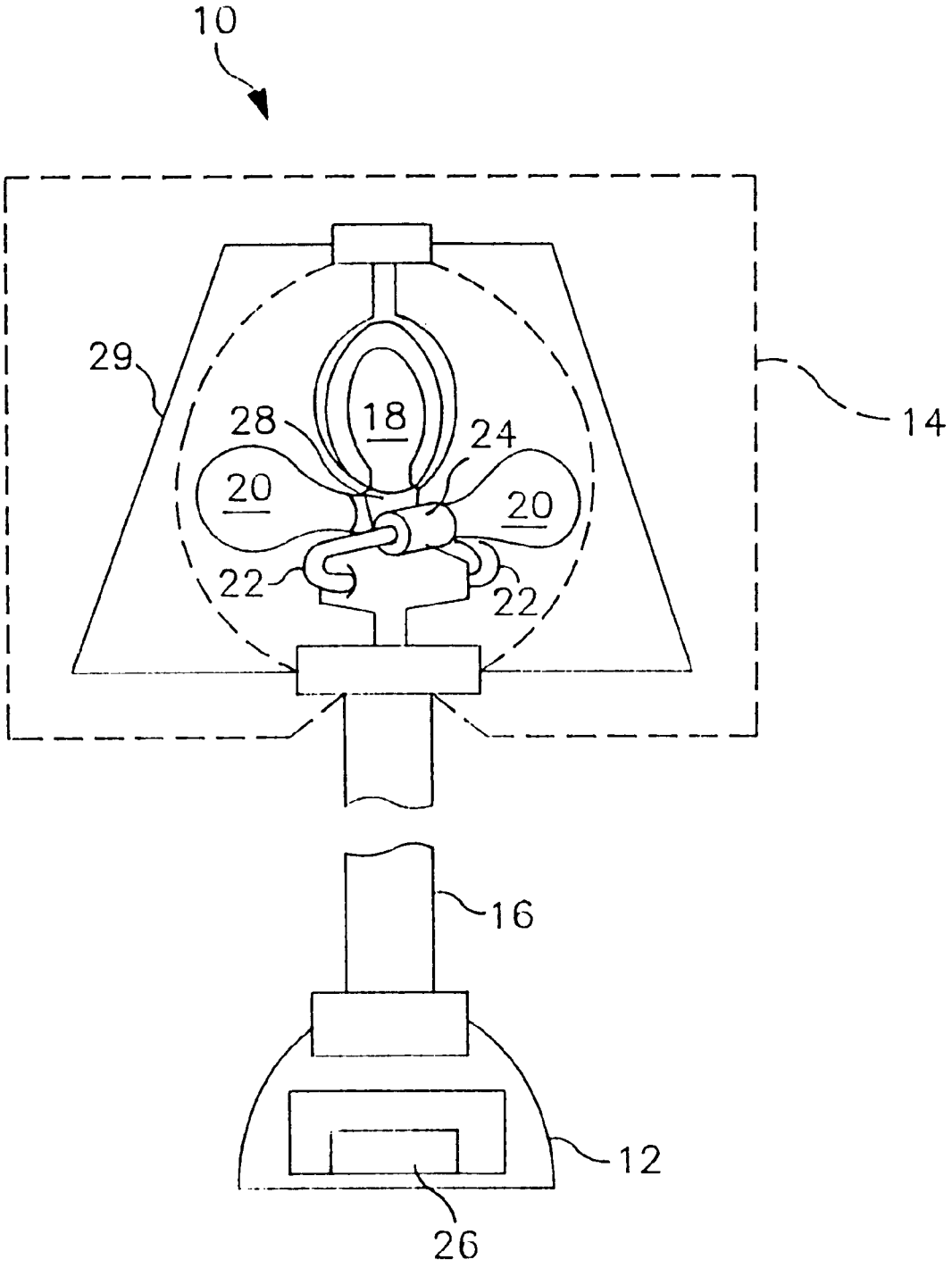
FIG. 1 PRIOR ART
FIG. 1 is a pictorial representation of a typical prior art metal halide floor or table lamp.

With reference to FIG. 1, the typical prior art combination metal halide and auxiliary light bulb floor or table lamp suitable for home or office illumination is illustrated. Lamp 10 includes a base 12 and a luminaire 14 which is supported by a supporting member 16 from the base 12. The luminaire 14 includes a metal halide bulb socket 28 and a metal halide bulb 18 and may include one or more auxiliary bulbs 20 which are positioned in a cluster using rigid tubing 22 to support the auxiliary bulb sockets 24. Typically, the luminaire 14 includes a lamp shade 29 or other light diffusion device positioned over the cluster of bulbs. The base 12 includes the electrical components 26 required to operate the metal halide and auxiliary bulbs 18,20.

As is apparent in the typical prior art lamp illustrated in FIG. 1, the electrical components 26 located in base 12 are physically separated from the bulb sockets 28,24 so that assembly of the lamp 10 includes complex electrical wiring connecting the electrical components 26 and the bulb sockets 28,24 adding time and cost to lamp assembly. A much higher skilled workforce is required to assemble the lamp than if the complex electrical wiring was not necessary during the assembly performed by the lamp manufacturer.

Further, the physical separation of the electrical components 26 and the bulb sockets 28,24 require lengths of wiring which result in the generation of RFI during lamp operation requiring the inclusion of additional interference suppressing components to minimize the RFI affects on other devices.

Figure 2:
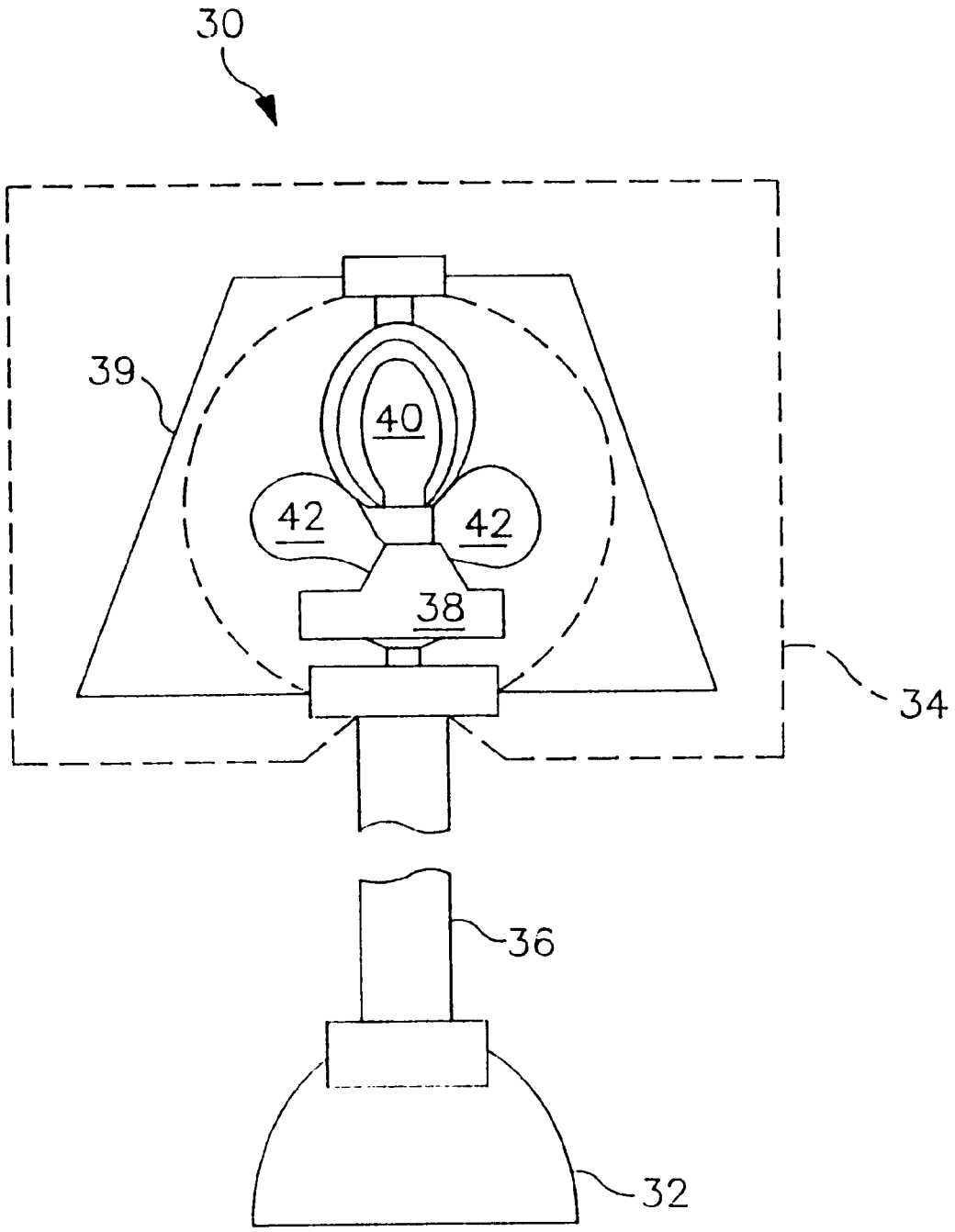
FIG. 2 is a pictorial representation of one embodiment of the metal halide floor or table lamp of the present invention.
Figure 3:
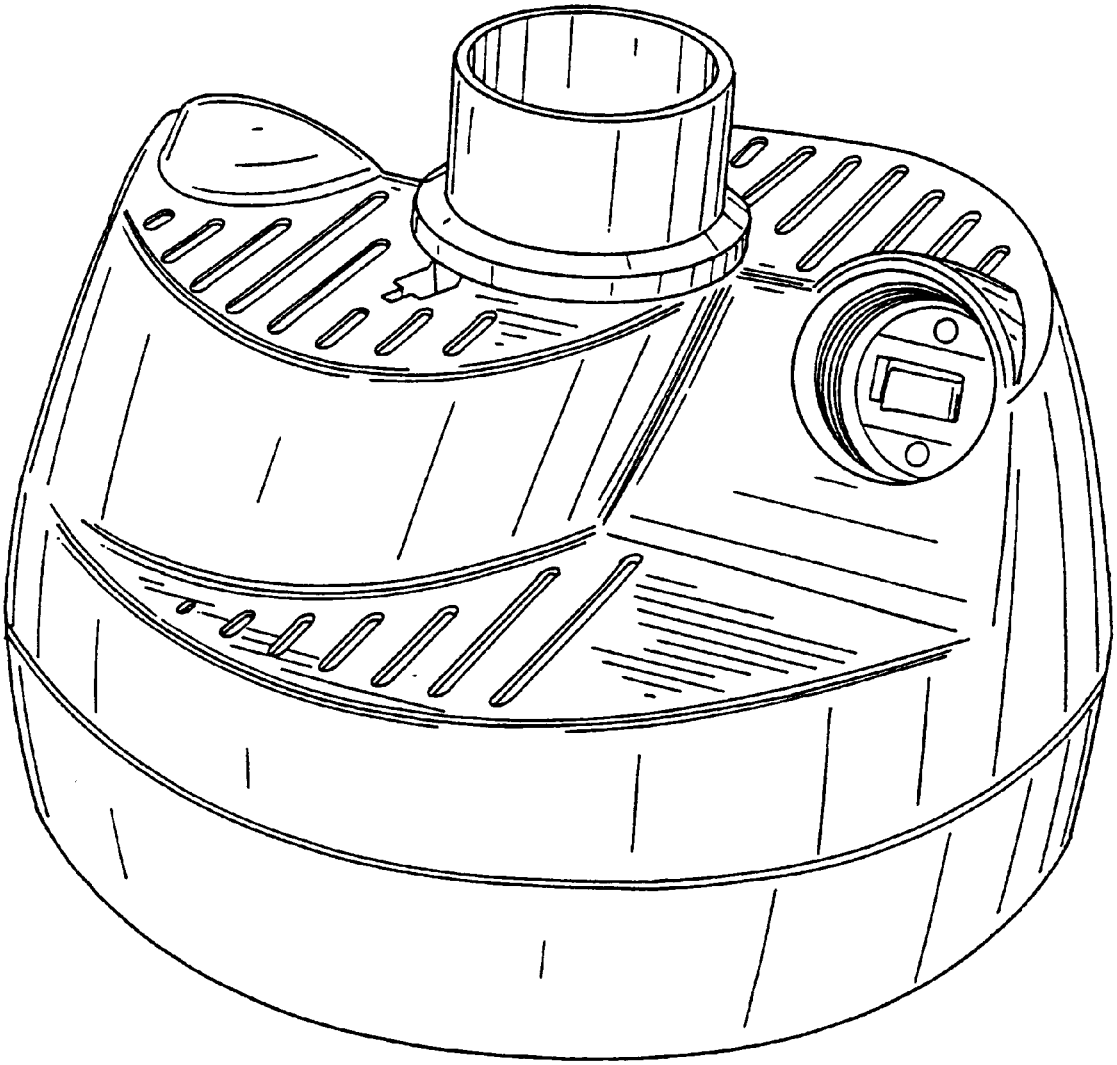
FIG. 3 is a pictorial representation of an embodiment of the lampholder module of the lamp of FIG. 2.

With reference to FIG. 2, the present invention is illustrated by an embodiment suitable as either a floor or table lamp for home or office illumination. The lamp 30 includes a base 32 and a luminaire 34 which is supported by a supporting member 36 from base 32. The luminaire 34 includes a lampholder module 38 and a metal halide bulb 40. The luminaire 34 may further include one or more auxiliary bulbs 42. The luminaire 34 may also include a lamp shade 39 or other light diffusing device positioned over the module 38 and the bulbs 40,42.

Figure 4A:
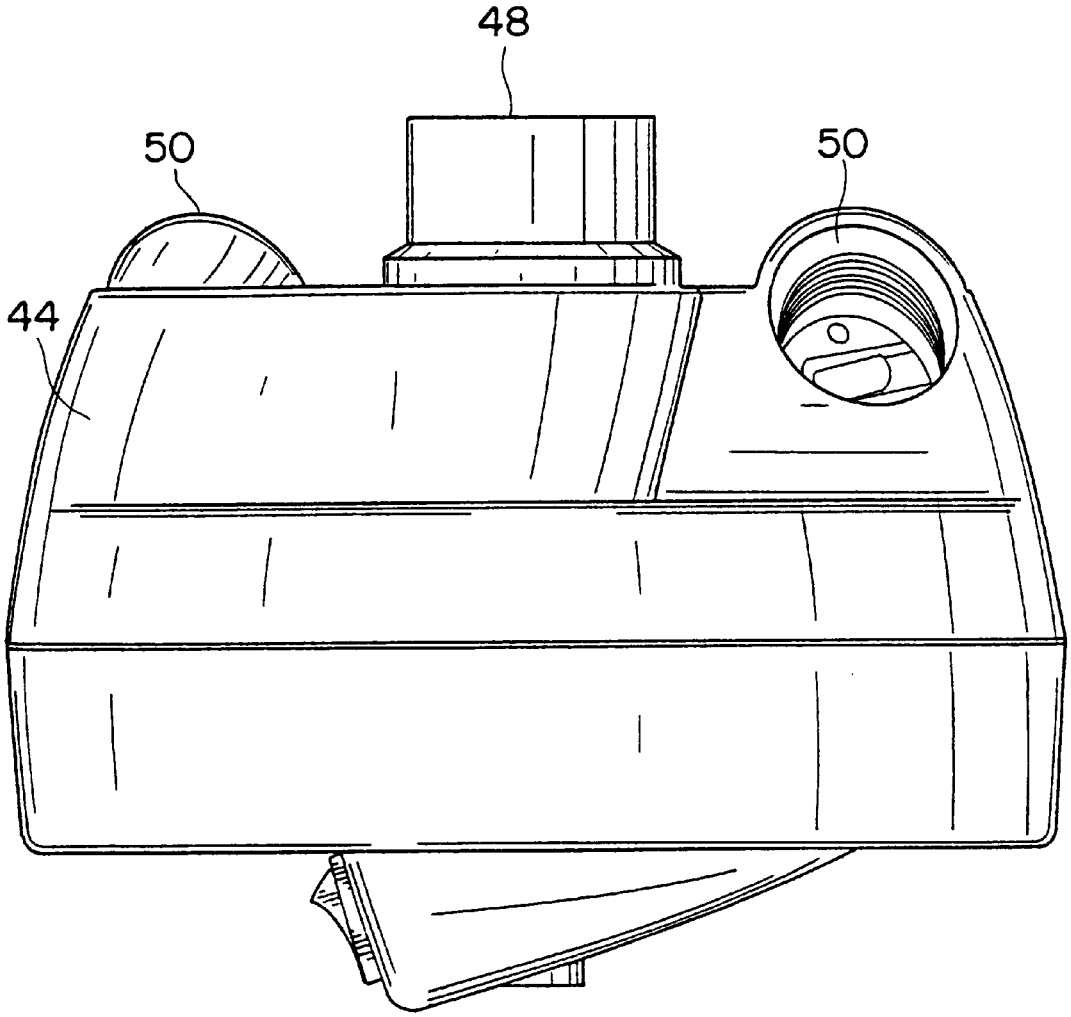
FIGS. 4*a* and 4*b* illustrate a side view and a cross-sectional view of the embodiment of the lampholder module of FIG. 3.
Figure 4B:
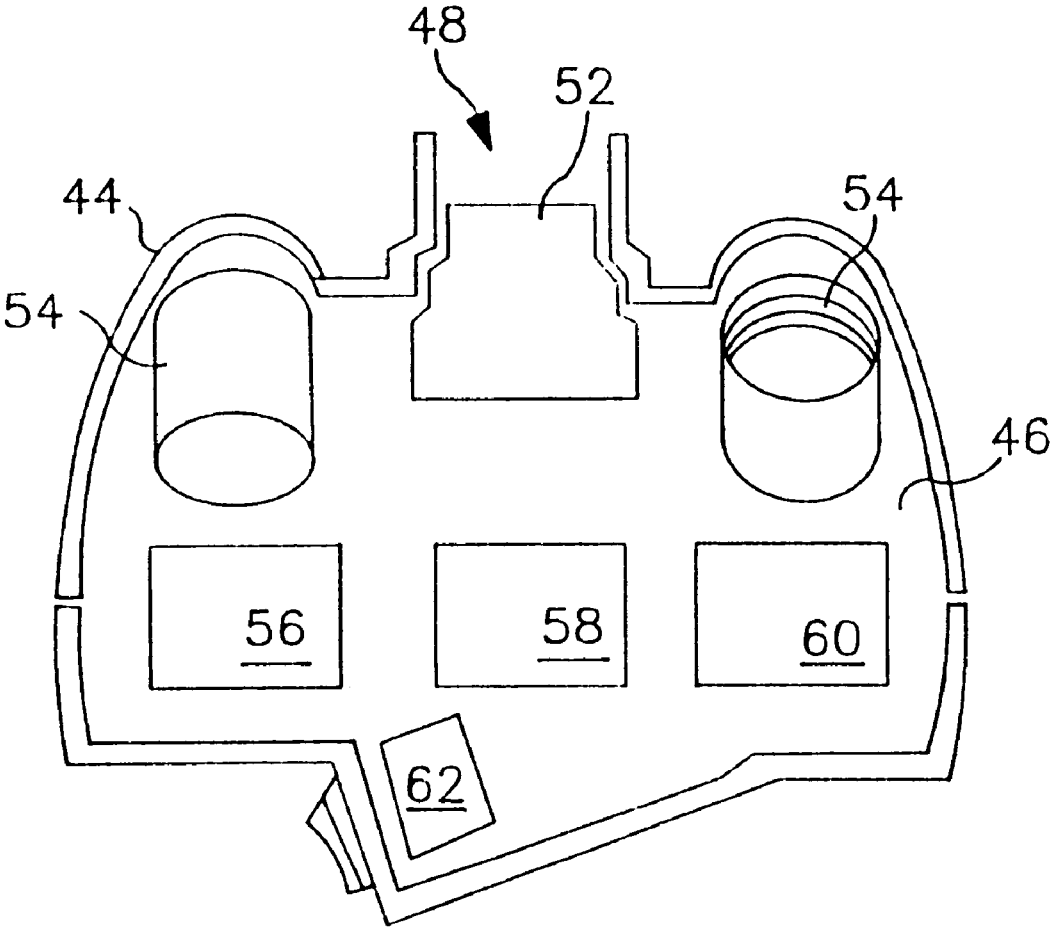

With reference to FIGS. 4*a* and 4*b*, wherein like elements are given like reference numerals to the elements of FIG. 2, the lampholder module 38 includes a housing 44 defining an internal cavity 46 and a metal halide bulb aperture 48. The housing 44 may further define one or more auxiliary light bulb apertures 50.

A metal halide bulb socket 52 is located within the cavity 46 in proximity to the metal halide bulb aperture 48 so that the power receiving end of a metal halide bulb may extend through the aperture 48 to be operatively connected into a socket 52. The socket 52 may be any conventional socket suitable for operatively and removably receiving a metal halide bulb. In the preferred embodiment, the socket 52 is a conventional socket for threadably receiving the base of a conventional edison based metal halide bulb.

In the embodiment illustrated, auxiliary bulb sockets 54 are located within the cavity 46 in proximity to an auxiliary bulb aperture 50 so that the power receiving end of an auxiliary bulb may extend through an aperture 50 to be operatively and removably connected into a socket 54. The sockets 54 may be any conventional socket suitable for operatively removably receiving an auxiliary bulb. In the preferred embodiment, the socket 54 is a conventional socket for threadably receiving the base of a conventional edison based incandescent or compact fluorescent bulb.

With further reference to FIG. 4*b*, the electrical components for operating the metal halide and auxiliary bulbs from sockets 52,54 respectively are located within the cavity 46 and include power supply 56, ballast 58, and illumination controls 60. These components may be any conventional components suitable for operating a metal halide and auxiliary bulbs from a typical interior home or office space power receptacle. Collocating the electrical components and bulb sockets within the cavity eliminates performing the complex electrical wiring connecting those components and the sockets during lamp assembly thus enabling a lesser skilled workforce to assemble the lamps and lowering the time and cost of lamp assembly. This arrangement also minimizes the generation of RFI during lamp operation thus further saving costs by eliminating the need for interference suppressing components. The housing 44 also provides protection of the complex electrical wiring during lamp assembly and transportation.

The lampholder module 38 may further include a switching means 62 within the cavity 46 to selectively illuminate either (i) the metal halide bulb 40, (ii) one or more auxiliary bulbs 42, or (iii) a combination of the metal halide bulb 40 and one or more auxiliary bulbs 42. In one embodiment of the lampholder module 38 using a plurality of incandescent bulbs as the secondary light source, the filament of one or more of the incandescent bulbs may be selectively included in the ballast circuit 58 operating the metal halide lamp 40 for dimming the metal halide lamp 40. When an incandescent filament is included in the ballast circuit 38, the incandescent bulb illuminates when power is applied to the ballast circuit. Less power is available to illuminate the metal halide bulb resulting in dimming of the bulb. The degree of dimming of the metal halide bulb is controlled by selectively including as many incandescent filaments in the ballast circuit as desired.

Figure 5A:
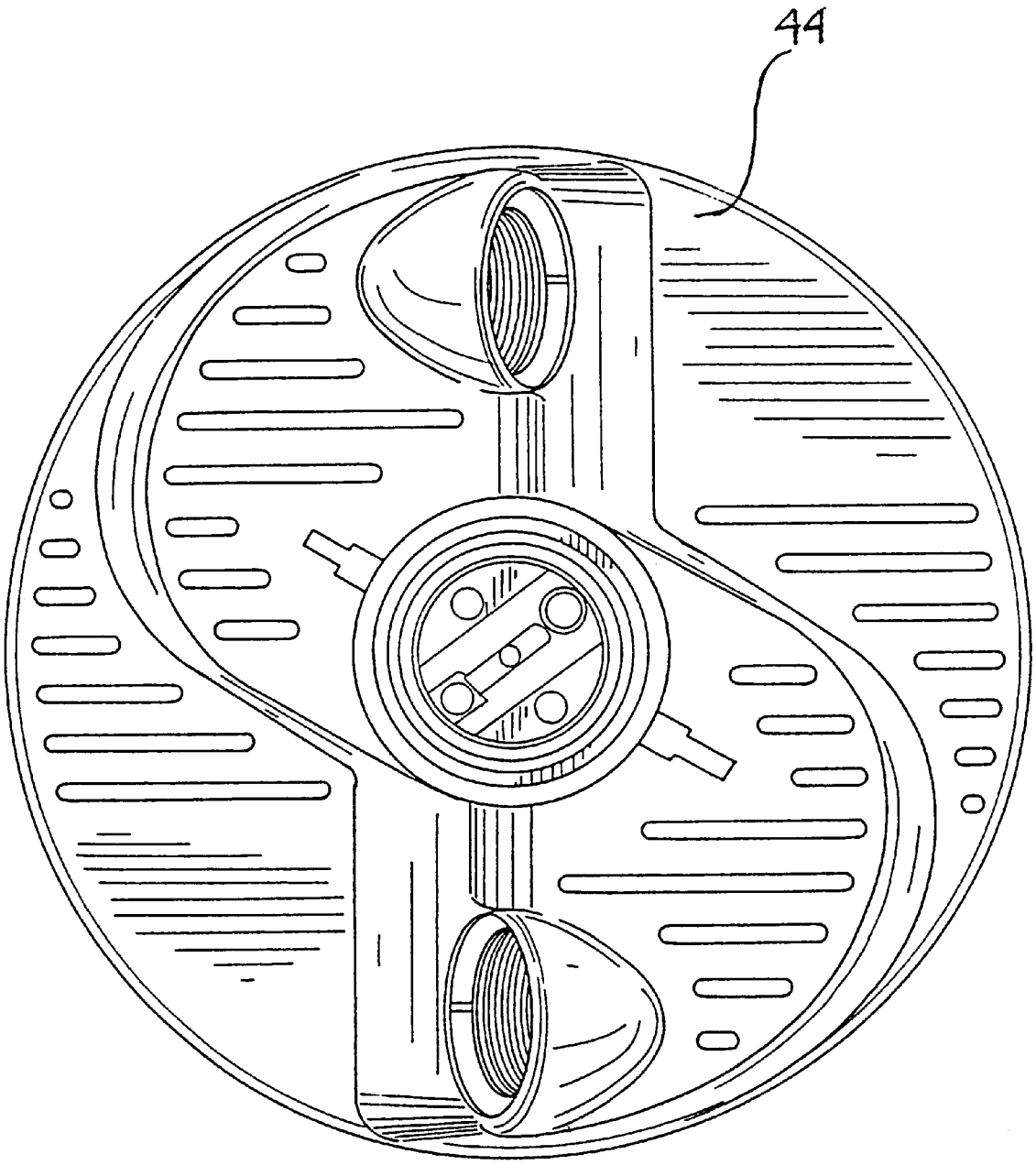
FIGS. 5*a* and 5*b* illustrate a plan view and a bottom view respectively of the embodiment of the lampholder module of FIG. 3.

With reference to FIG. 5*a* illustrating a preferred embodiment of the lampholder module 38, the metal halide bulb aperture 48 is centrally positioned in the upper surface of housing 44 with the longitudinal axis of metal halide bulb socket 52 defining the vertical axis of the module 38. A plurality of auxiliary bulb apertures 50, with the auxiliary bulb sockets 54 positioned within the cavity 46 in proximity thereto, are positioned symmetrically along a circumference around the central metal halide bulb aperture 48 and socket 52. In the preferred embodiment illustrated by FIG. 5*a,* two auxiliary bulb apertures 50 and sockets 54 are positioned on opposite sides of the central metal halide bulb aperture 48 and socket 52.

The longitudinal axes of the sockets 54 are each perpendicular to the radius of the circumference on which the sockets are positioned and are angled relative to the axis of the metal halide socket 52 which is vertical. In the preferred embodiment, the axes are angled 45 degrees from the vertical axis. The angled positioning of the auxiliary sockets relative to the metal halide socket positions the bulbs connected thereto so that neither bulb casts a shadow as a result of light emanating from another bulb, i.e., the relative positioning of the bulbs minimizes "shadowing."

Module 38 provides rigid positioning of the bulbs which is not susceptible to distortion such as bending and provides a cluster of bulbs which is more space efficient, i.e., tighter, than the S-arm cluster arrangement. The tighter cluster arrangement requires a smaller diffusion device (such as a lamp shade) which results in a higher light output than the S-arm cluster arrangement.

Figure 5B:
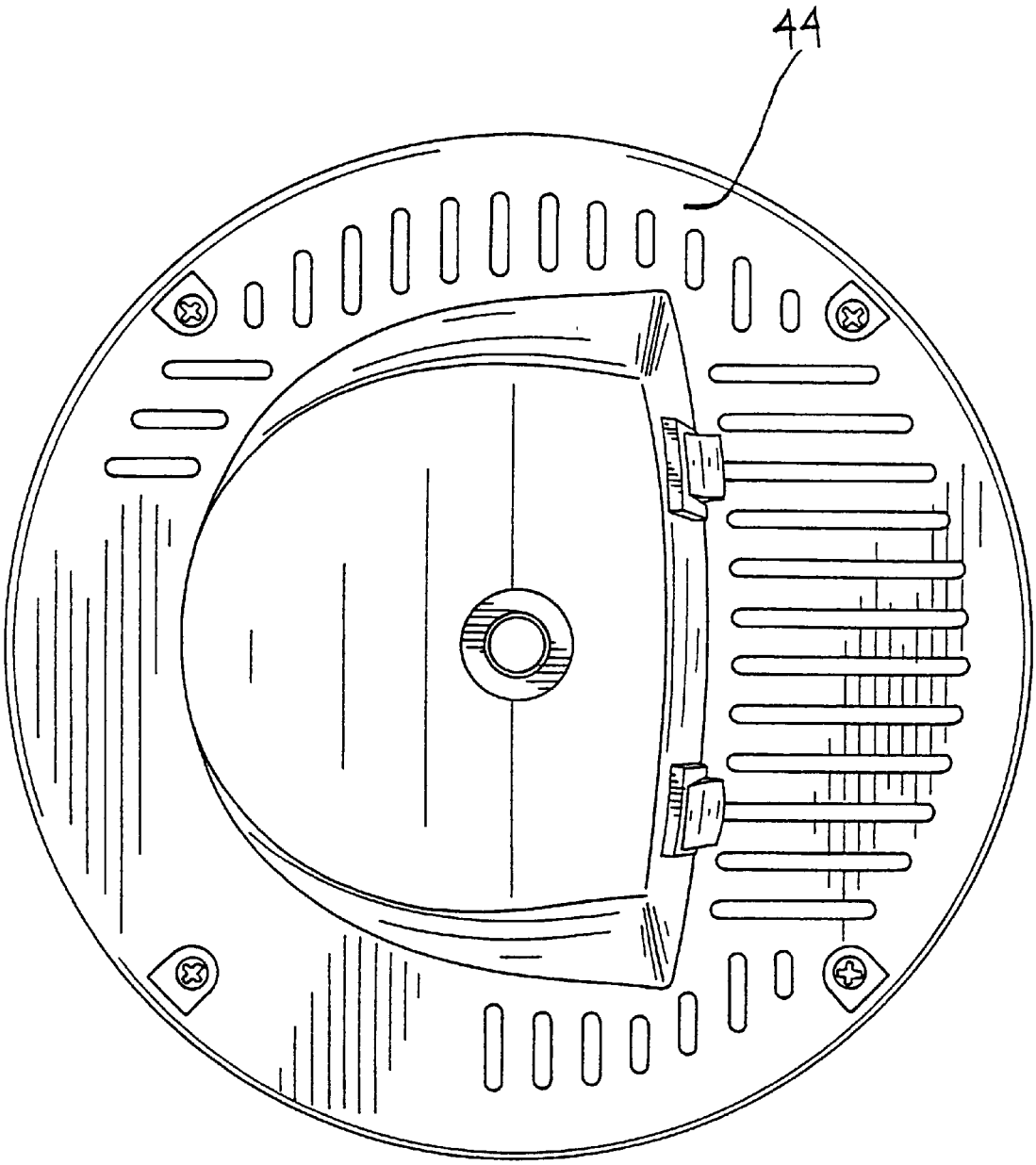

As shown in FIGS. 5*a* and 5*b,* the housing 44 may further define ventilation apertures in the upper and lower surfaces. During lamp illumination, the heat generated by the illuminated bulbs above the upper surface of the housing causes a natural circulation of air to flow upward through the ventilation apertures in the lower housing surface, past the electrical components in the housing cavity, and through the ventilation apertures in the housing upper surface providing convective cooling of the electrical components. The convective cooling of the electrical components by natural circulation of air eliminates the need for a cooling fan which reduces the cost of the lamp by reducing the number of components and power consumption.

Figure 6:
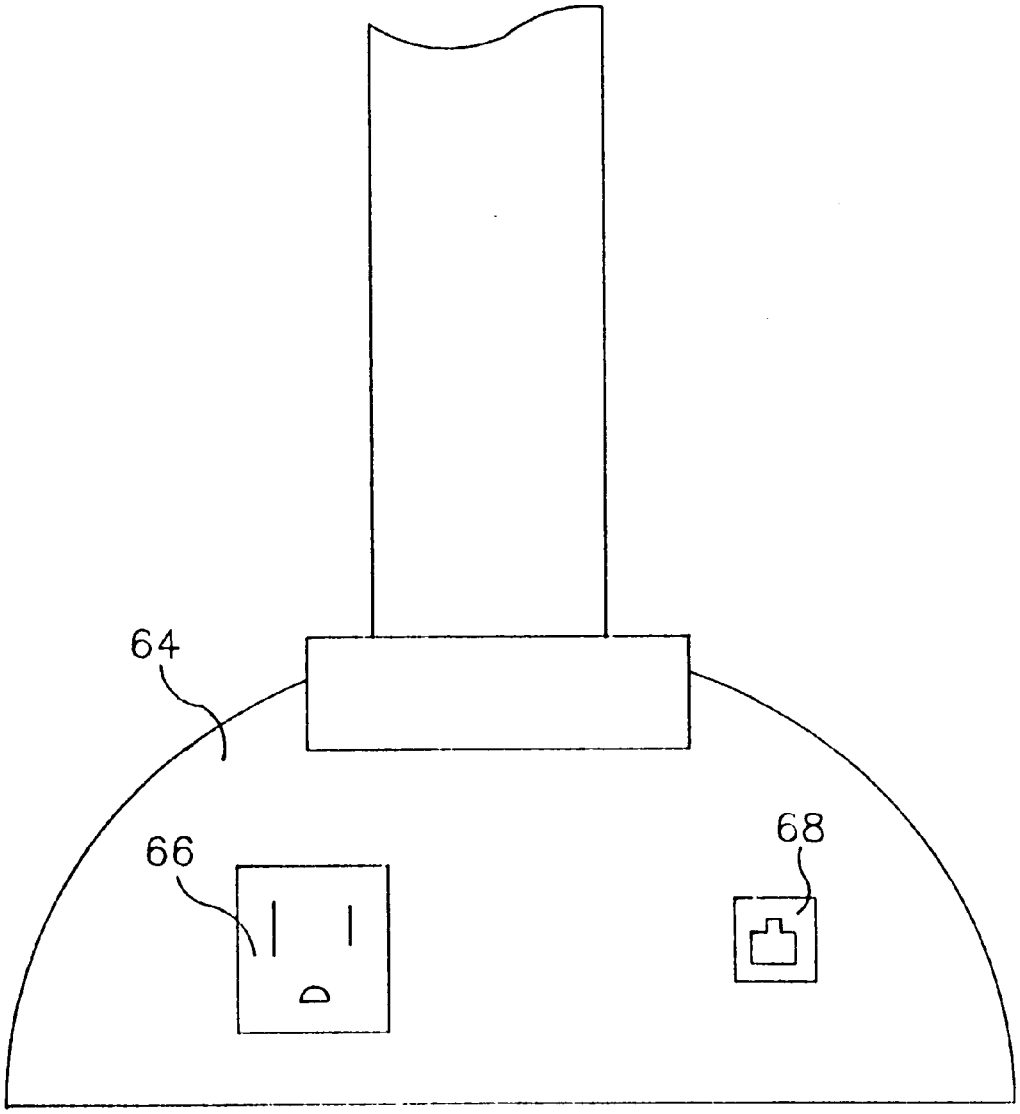
FIG. 6 illustrates one embodiment of the lamp base of the lamp of FIG. 2.

With reference to FIG. 6, one embodiment of the lamp of the present invention may include a base 64 to combine the advantages of metal halide light with a personal workstation in the home, office or hotel room. The base 64 includes a grounded convenience receptacle 66 for providing electrical power to devices such as a personal computer or a cellular telephone recharger. The base 64 may also include a dataport 68 which is a modular ISDN fax/modem jack for connection to a telecopier or personal computer.

Figure 7:
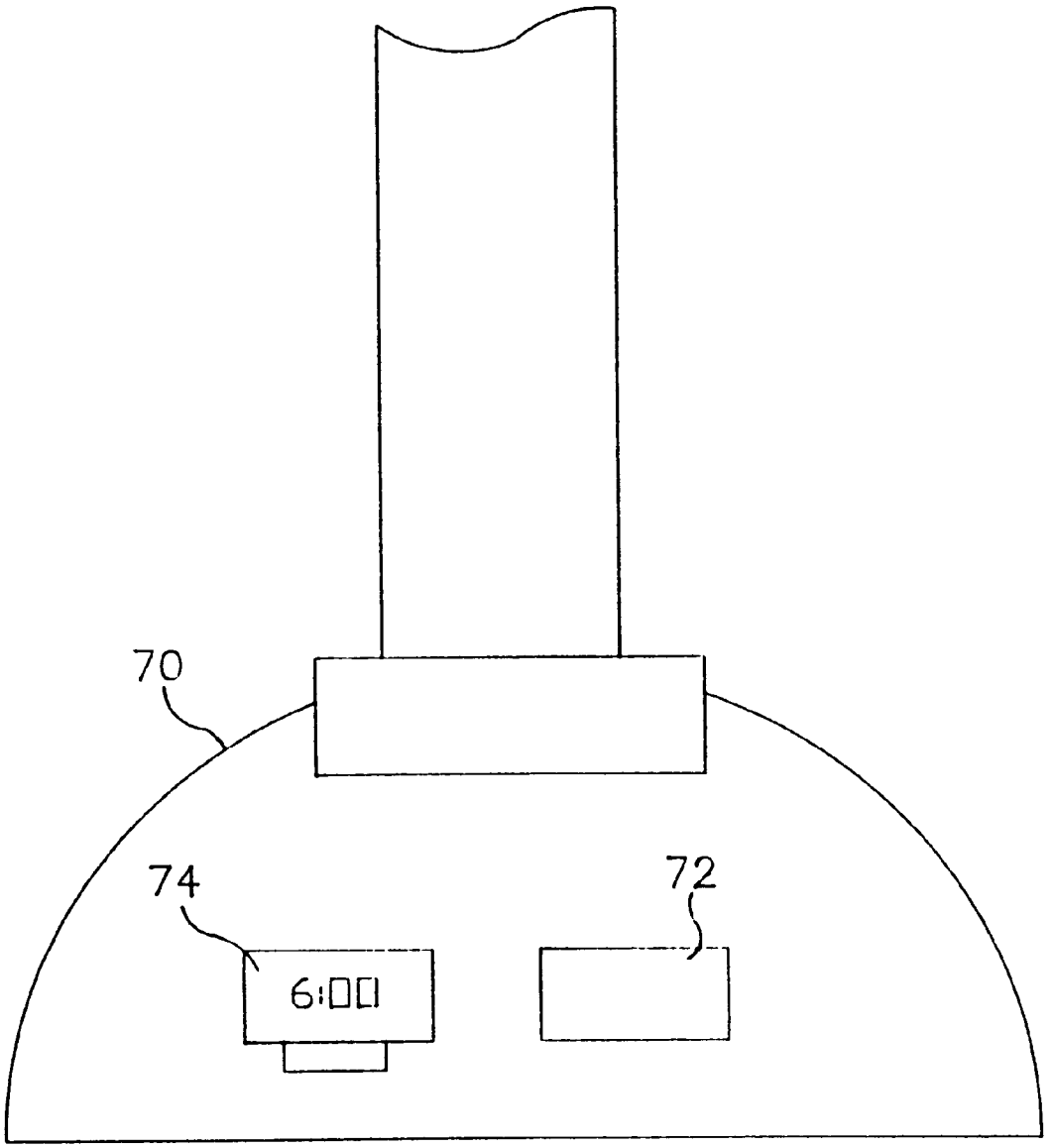
FIG. 7 illustrates a second embodiment of the lamp base of the lamp of FIG. 2.

With reference to FIG. 7, a second embodiment of the lamp of the present invention may include a base 70 to take advantage of the natural full-spectrum light emanating from a metal halide bulb in helping to alleviate seasonal affective disorders ("SAD") caused by the seasonal light changes. The base 70 includes a timing device 72 which may gradually illuminate one or more incandescent auxiliary bulbs at a selected time of day. The timing device 72 may also provide gradual illumination of the metal halide bulb or provide for the illumination of the metal halide bulb when the incandescent bulb are fully illuminated. The base 70 may also include a display 74 of the time of day.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. A portable combination metal halide and auxiliary bulb lamp suitable for interior living space area illumination comprising:

a base;

a luminaire comprising:

(a) a housing defining (i) an internal cavity, (ii) a metal halide bulb aperture, and (iii) one or more auxiliary bulb apertures;

(b) a selectively operable electronics assembly within said cavity, said assembly including a power supply and ballast circuitry operatively connected to said power supply;

(c) a metal halide bulb socket positioned within said cavity in proximity to said aperture to operatively and removably receive the base of a metal halide bulb therethrough, said socket being operatively connected to said electronics assembly; and (d) one or more auxiliary bulb sockets positioned within said cavity in proximity to an auxiliary bulb aperture to operatively and removably receive the base of an auxiliary bulb therethrough, each of said auxiliary sockets being operatively connected to said electronics assembly;

support means supporting said luminaire from said base; and power means for supplying a.c. power from an external power source through said base to said electronics assembly.

2. The lamp of claim 1 wherein said base comprises:

(i) an a.c. power receptacle operatively connected to said a.c. power means for providing power to devices connected thereto;

(ii) a dataport; and (iii) means for operatively connecting said dataport to a remote telephone line for operatively connecting devices plugged into said dataport to said telephone line.

3. The lamp of claim 1 further comprising a timing device to selectively effect the illumination of the auxiliary bulbs connected thereto.

4. The lamp of claim 3 wherein said timing device is also operable to effect the illumination of the metal halide bulb connected thereto.

5. The lamp of claim 3 wherein said timing device effects the gradual illumination of said auxiliary bulbs.

6. The lamp of claim 5 wherein said device is operatively connected to said metal halide bulb socket to effect the illumination of the metal halide bulb connected thereto at or near the completion of the gradual illumination of said auxiliary bulbs.

7. A unitary module for a combination metal halide and incandescent bulb lamp comprising:

(a) a housing defining:

(i) an internal cavity, (ii) a central aperture adapted to enable passage of the power receiving end of a metal halide bulb therethrough, said aperture having a longitudinal axis defining the vertical axis of said module, (iii) two perimeter apertures each adapted to enable passage of the power receiving end of an auxiliary bulb therethrough, said perimeter apertures being positioned along a circumference around said central aperture on opposite sides of said central aperture, each of said perimeter apertures having a longitudinal axis which is angled about 45 degrees from the vertical axis and is perpendicular to the radius of said circumference, and (iv) ventilation apertures adapted to enable convective cooling of components within said cavity during lamp illumination;

(b) an electronics assembly within said cavity, said assembly including a power supply for receiving power from a suitable external power source, ballast circuitry operatively connected to said power supply, and illumination controls;

(c) a metal halide bulb socket within said cavity, said metal halide bulb socket being positioned in proximity to said central aperture to operatively and removably receive a metal halide bulb therethrough, said metal halide bulb socket being operatively connected to said ballast circuitry; and (d) two auxiliary bulb sockets within said cavity, each of said auxiliary bulb sockets being positioned in proximity to one of said perimeter apertures to operatively and removably receive an auxiliary bulb therethrough.

8. A unitary module for a portable metal halide lamp comprising:

a housing defining (i) an internal cavity and (ii) a metal halide bulb aperture;

an electronics assembly within said cavity, said assembly including a power supply and ballast circuitry operatively connected to said power supply; and a metal halide bulb socket within said cavity, said socket being positioned in proximity to said aperture to operatively and removably receive a metal halide bulb therethrough, said socket being operatively connected to said electronics assembly.

9. The module of claim 8 further comprising an auxiliary bulb socket and wherein said housing further defines an auxiliary bulb aperture, said auxiliary bulb socket being positioned within said cavity in proximity to said auxiliary bulb aperture to operatively and removably receive an auxiliary bulb therethrough.

10. The module of claim 9 wherein said auxiliary bulb socket is an incandescent bulb socket.

11. The module of claim 10 wherein said incandescent bulb socket is operatively connected to said ballast circuitry.

12. The module of claim 9 wherein said auxiliary bulb socket is a compact fluorescent bulb socket.

13. The module of claim 9 comprising a plurality of auxiliary bulb sockets and wherein said housing defines a plurality of auxiliary bulb apertures.

14. The module of claim 9 wherein said auxiliary bulb socket is positioned to minimize shadowing of the light provided by the auxiliary bulb illuminated therefrom by the light provided by the metal halide bulb illuminated from said metal halide bulb socket.

15. The module of claim 14 comprising a plurality of auxiliary bulb sockets and wherein said housing defines a plurality of auxiliary bulb apertures.

16. The module of claim 9 wherein each of said apertures has a longitudinal axis, the axis of said auxiliary bulb aperture being at an angle relative to the axis of said metal halide bulb aperture.

17. The module of claim 16 wherein the longitudinal axes of said metal halide and said auxiliary bulb apertures are each perpendicular to a common line.

18. The module of claim 16 comprising a plurality of auxiliary bulb sockets and wherein said housing defines a plurality of auxiliary bulb apertures.

19. The module of claim 9 wherein said metal halide bulb aperture has a longitudinal axis defining a central axis of said module.

20. The module of claim 19 wherein said central axis is the vertical axis of said module.

21. The module of claim 19 further comprising a plurality of auxiliary bulb sockets and wherein said housing defines a plurality of auxiliary bulb apertures symmetrically positioned along a circumference around said metal halide bulb aperture.

22. The module of claim 21 wherein each of said auxiliary bulb apertures has a longitudinal axis being at an angle relative to the longitudinal axis of said metal halide bulb aperture.

23. The module of claim 22 wherein said relative angle is about 45 degrees.

24. The module of claim 22 wherein the longitudinal axis of each of said auxiliary bulb apertures is perpendicular to the radius of said circumference.

25. The module of claim 9 further comprising illumination controls to selectively provide (i) only metal halide bulb illumination, (ii) only auxiliary light bulb illumination, or (iii) both metal halide and auxiliary light bulb illumination.

26. The module of claim 8 wherein said metal halide bulb aperture has a longitudinal axis defining a central axis of said module.

27. The module of claim 26 wherein said central axis is the vertical axis of said module.

28. The module of claim 8 wherein said housing further defines ventilation apertures adapted to enable convective cooling of the components of said electronics assembly during illumination of said lamp.

29. The module of claim 8 further comprising illumination controls operatively connected to said ballast circuitry.

30. A portable combination metal halide and auxiliary bulb lamp suitable for interior living space area illumination comprising a luminaire supported above a base, said luminaire comprising (i) an interior region, (ii) an electronics assembly installed in said region, said assembly including a power supply, ballast circuitry operatively connected thereto, and illumination controls, (iii) a metal halide bulb socket, and (iv) a plurality of auxiliary light bulb sockets, said metal halide and auxiliary bulb sockets being operatively connected to said electronics assembly and located within said region and positioned to receive the base of bulbs located substantially outside said region.

31. A unitary metal halide lamp module comprising:

(a) a housing defining (i) an internal cavity, and (ii) a metal halide bulb aperture adapted to enable passage of the power receiving end of a metal halide bulb therethrough from external of said cavity;

(b) an electronics assembly within said cavity, said assembly including a power supply, ballast circuitry operatively connected to said power supply, and illumination control circuitry;

(c) a metal halide bulb socket operatively connected to said electronics assembly, said socket being positioned within said cavity in proximity to said metal halide bulb aperture to operatively and removably receive the power receiving end of a metal halide bulb;

(d) cord and plug means for electrically connecting said power supply within said cavity to a suitable external source of power; and (e) switch means within said cavity and manually operable external of said housing for controlling the application of power to said metal halide bulb socket.

32. The module of claim 31 further comprising:

(f) an auxiliary bulb socket positioned within said cavity in proximity to an auxiliary bulb aperture for operatively and removably receiving an auxiliary bulb therethrough, said auxiliary aperture being defined by said housing.

33. The module of claim 32 wherein said auxiliary light bulb socket is an incandescent light bulb socket.

34. The module of claim 33 wherein said incandescent bulb socket is operatively connected to said ballast circuitry.

35. The module of claim 32 wherein said auxiliary light bulb socket is a compact fluorescent bulb socket.

36. The module of claim 32 further comprising an auxiliary switch means for controlling the application of power to said auxiliary light bulb socket.

37. The module of claim 32 wherein said switch means operates to selectively apply power to (i) only said metal halide bulb socket, (ii) only said auxiliary light bulb socket, or (iii) both the metal halide and auxiliary light bulb sockets.

38. The module of claim 32 wherein said housing defines a plurality of auxiliary apertures and wherein said module further comprises a plurality of auxiliary light bulb sockets.

39. The module of claim 38 wherein the longitudinal axis of said metal halide socket defines the central vertical axis of said module, said auxiliary bulb apertures being symmetrically positioned along a circumference around said metal halide bulb aperture.

40. The module of claim 39 wherein each of said auxiliary bulb apertures has a longitudinal axis being at an angle relative to the longitudinal axis of said metal halide bulb aperture.

41. The module of claim 31 wherein said metal halide bulb aperture has a longitudinal axis defining a central axis of said module.

42. The module of claim 31 wherein said housing further defines ventilation apertures adapted to enable convective cooling of the components of said electronics assembly during illumination of said lamp.

43. A method of manufacturing a portable metal halide lamp comprising the steps of:

(a) providing a housing defining (i) an internal cavity and (ii) a metal halide bulb aperture;

(b) providing an electronics assembly within said internal cavity, said assembly including a power supply, ballast circuitry, and illumination controls;

(c) positioning a metal halide bulb socket within said cavity in proximity to said aperture to operatively and removably receive a metal halide bulb therethrough, said socket being operatively connected to said electronics assembly.

44. The method of claim 43 further comprising the step of positioning an auxiliary bulb socket within said cavity in proximity to an auxiliary bulb aperture to operatively and removably receive an auxiliary bulb therethrough, said auxiliary bulb aperture being defined by said housing.

45. The method of claim 44 further comprising the step of positioning a plurality of auxiliary bulb sockets symmetrically along a circumference around said metal halide bulb socket wherein the longitudinal axis of said metal halide bulb socket defines the vertical axis of said housing, each of said auxiliary light bulb sockets having a longitudinal axis perpendicular to the radius of said circumference.

46. The method of claim 44 further comprising the step of providing a switch means to selectively provide power to (i) only the metal halide bulb socket, (ii) only the auxiliary light bulb socket, or (iii) both the metal halide and auxiliary light bulb sockets.

47. The method of claim 44 wherein said auxiliary light bulb socket is an incandescent light bulb socket.

48. The method of claim 44 wherein said auxiliary light bulb socket is a compact fluorescent light bulb socket.

49. A combination metal halide and auxiliary bulb lamp comprising:

a housing defining (i) an internal cavity, (ii) a metal halide lamp aperture adapted to receive the power receiving end of a metal lamp therethrough from external of said cavity, and (iii) one or more auxiliary bulb apertures adapted to receive the power receiving end of an auxiliary bulb therethrough from external of said cavity;

an electronics assembly within said cavity;

a metal halide bulb socket operatively connected to said assembly, said metal halide bulb socket being positioned within said cavity in proximity to said metal halide bulb aperture to operatively and removably receive the power receiving end of a metal halide bulb;

one or more auxiliary bulb sockets positioned within said cavity in proximity to an auxiliary bulb aperture to operatively and removably receive the power receiving end of an auxiliary bulb;

a metal halide bulb substantially external of said cavity, the power receiving end of said metal halide bulb being operatively and removably received through said metal halide bulb aperture into said metal halide bulb socket; and one or more auxiliary bulbs substantially external of said cavity, the power receiving end of each of said auxiliary bulbs being operatively and removably received through an auxiliary bulb aperture into an auxiliary bulb socket.

* * * * *